US009956778B2

(12) United States Patent
Okubo

(10) Patent No.: US 9,956,778 B2
(45) Date of Patent: May 1, 2018

(54) LIQUID EJECTING HEAD UNIT AND LIQUID EJECTING APPARATUS

(71) Applicant: SEIKO EPSON CORPORATION, Tokyo (JP)

(72) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/206,094

(22) Filed: Jul. 8, 2016

(65) Prior Publication Data

US 2017/0008284 A1 Jan. 12, 2017

(30) Foreign Application Priority Data

Jul. 8, 2015 (JP) ..... 2015-137264

(51) Int. Cl.
*B41J 2/135* (2006.01)
*B41J 2/14* (2006.01)

(52) U.S. Cl.
CPC ..... *B41J 2/1433* (2013.01); *B41J 2/14233* (2013.01); *B41J 2002/14362* (2013.01)

(58) Field of Classification Search
None
See application file for complete search history.

(56) References Cited

U.S. PATENT DOCUMENTS 6,238,042 B1 * 5/2001 Kobayashi ..... B41J 2/17506 347/86
2001/0030676 A1 * 10/2001 Owaki ..... B41J 2/17513 347/93
2008/0043059 A1 2/2008 Okazawa et al.
2014/0118437 A1 * 5/2014 Watanabe ..... B41J 2/14233 347/22
2014/0240401 A1 8/2014 Okubo
2014/0368584 A1 12/2014 Kanegae
2014/0375727 A1 12/2014 Kanegae

FOREIGN PATENT DOCUMENTS

JP 2009-006730 1/2009
JP 2014-162063 9/2014
JP 2015-000542 1/2015
JP 2015-003421 1/2015

* cited by examiner

*Primary Examiner* — Matthew Luu
*Assistant Examiner* — Tracey McMillion
(74) *Attorney, Agent, or Firm* — Workman Nydegger

(57) ABSTRACT

A liquid ejecting head unit includes a first flow path member with a first flow path and a second flow path member with a second flow path which is stacked on the first flow path member. A seal member connects the first and second flow paths and has a first seal part and a second seal part. The first flow path member applies a force to the first seal part in a stacking direction of the first and second flow path members. The second flow path member applies a force to the second seal part in a direction from the center of the second flow path to the outside and normal to the stacking direction. A retaining part controls expansion of the seal member in the normal direction with a control part. A drive element ejects liquid supplied through the first and the second flow paths through nozzles.

16 Claims, 7 Drawing Sheets

LIQUID EJECTING HEAD UNIT AND LIQUID EJECTING APPARATUS

BACKGROUND

1. Technical Field

The present invention relates to a liquid ejecting head unit that ejects liquid through nozzles and to a liquid ejecting apparatus including the liquid ejecting head unit. More specifically, the invention relates to an ink jet recording head unit that ejects ink as the liquid and an ink jet recording apparatus including the ink jet recording head unit.

2. Related Art

Ink jet recording head units that eject ink droplets are a representative example of liquid ejecting head units that eject liquid. For example, JP-A-2009-6730 proposes an ink jet recording head unit that includes an ink jet recording head and a flow path member. The ink jet recording head ejects ink droplets through the nozzles. The flow path member is fixed to the ink jet recording head and allows ink in a liquid storage unit that stores the ink, such as an ink cartridge, to be supplied to the ink jet recording head.

The flow path member in the ink jet recording head unit includes an upstream flow path member and a downstream flow path member that holds the ink jet recording head; the upstream and downstream flow path members allow the ink in the liquid storage unit to be supplied to the ink jet recording head. In addition, a seal member made of an elastic material, such as a rubber sheet, is interposed between the upstream and downstream flow path members in order to suppress the ink from leaking from the connecting parts of the upstream and downstream flow paths.

The above configuration in which the seal member between the upstream and downstream flow path members hermetically seals the connecting parts of the upstream and downstream flow paths has some disadvantages. More specifically, the seal member generates a repelling force in response to its elastic deformation, and this repelling force applies forces to the upstream and downstream flow path members in the directions in which the upstream and downstream flow path members are separated from each other. In addition, a force is applied vertically to the liquid ejection surface of the liquid ejecting head from which ink droplets are to be ejected. Consequently, the upstream and downstream flow path members may be separated from the liquid ejecting head, or stacked members constituting the liquid ejecting head may be separated from one another. Moreover, the liquid ejection surface of the liquid ejecting head may be warped, in which case locations at which ink droplets are to be placed on a medium, such as a paper sheet, might be displaced.

As another example, JP-A-2015-003421 proposes a configuration (first exemplary configuration) in which a first flow path is connected to a second flow path with a tube therebetween, which helps decrease a force applied vertically to a liquid ejection surface.

JP-A-2015-000542 proposes a configuration (second exemplary configuration) in which a first flow path is connected to a second flow path with a tubular seal member therebetween. This tubular seal member presses the first flow path in a radial direction and also presses the second flow path in a direction perpendicular to a liquid ejection surface.

The first exemplary configuration involves a complex assembly process in which the tubular seal member is inserted into the first and second flow paths while the first and second flow paths are aligned with one another. More specifically, when the seal member that has been inserted into the first flow path is inserted into the second flow path, a manufacturer may fail to visually check the connecting parts of the seal member and of the second flow path, in which case the first flow path might be misaligned with the second flow path and thus ink might leak from the connecting parts.

Although the second exemplary configuration can be assembled by a simple process, if the tubular seal member expands in response to application of pressure to the ink, the adhesion between the seal member and projecting parts formed in the first and second flow paths may decrease, in which case an ink leakage might occur between the seal member and the projecting parts.

The above disadvantages are common not only to ink jet recording head units but also to liquid ejecting head units that eject liquid other than ink.

SUMMARY

An advantage of some aspects of the invention is that: a liquid ejecting head unit can be assembled by a simple process and exhibits a good contact performance between its components, thereby reducing the risk of liquid leaking; and a liquid ejecting apparatus includes the liquid ejecting head unit.

First Aspect

A liquid ejecting head unit includes: a first flow path member having a first flow path; and a second flow path member having a second flow path. The second flow path member is stacked on the first flow path member. A seal member connects the first flow path to the second flow path and has a first seal part and a second seal part. The first flow path member applies a force to the first seal part in a stacking direction in which the second flow path member is stacked on the first path member. The second flow path member applies a force to the second seal part in a direction from a center of the second flow path to an outside thereof, the direction being normal to the stacking direction. A bar (retaining part) against controls expansion of the seal member in the normal direction by a control part. A drive element ejects liquid through a nozzle, the liquid having been supplied through both the first flow path and the second flow path.

According to the first aspect, the first flow path member applies a force in the stacking direction to the seal member that connects the first flow path to the second flow path, thereby helping position the first flow path member relative to the seal member and connect the first flow path to the second flow path. The second flow path member applies a force to the seal member in the direction normal to the stacking direction, thereby reducing the force applied to the seal member in the stacking direction. The retaining part reduces expansion of the seal member, thereby controlling the decrease in the adhesion between the connecting parts of the seal member and of the second flow path, for example, when pressure is applied to liquid. With this configuration, liquid is less likely to leak from the liquid ejecting head unit. Furthermore, the liquid ejecting head unit can be assembled by a process of: stacking the seal member on the second flow path member with the retaining part abutting against the seal member; and stacking the first flow path member on the seal member. Since the first flow path member applies a force to the seal member in the stacking direction, excessive stress is applied to the seal member during the assembly process; therefore, the seal member is less likely to be bent or deformed.

Second Aspect

In the liquid ejecting head unit according to the first aspect, an outer diameter of the first seal part is preferably smaller than an inner diameter of the control part, as viewed from the stacking direction.

According to the second aspect, the retaining part can be disposed without interfering with the first seal part in the seal member.

Third Aspect

In the liquid ejecting head unit according to the first or second aspect, the seal member preferably has a flat part disposed outside the second seal part with respect to a center of the first flow path in the normal direction. The flat part preferably has a first surface and a second surface, the first surface being at a side of the first flow path member with respect to the second surface, the second surface being at a side of the second flow path member with respect to the first surface. The control part is preferably disposed so as to face the first surface of the flat part.

According to the third aspect, the retaining part can be disposed such that the control part does not interfere with the flat part.

Fourth Aspect

In the liquid ejecting head unit according to the third aspect, the retaining part preferably has an abutting part that abuts against the flat part.

According to the fourth aspect, even if the flat part floats over the second flow path member when the seal member is stacked on the second flow path member, the abutting part can suppress the floating of the flat part by pressing the flat part onto the second flow path member.

Fifth Aspect

In the liquid ejecting head unit according to one of the first to fourth aspects, the seal member preferably has a projection that protrudes from the center of the second flow path to the outside thereof in the normal direction and that abuts against the retaining part. A corner of the projection which is closer to the first seal part in the stacking direction is preferably chamfered.

According to the fifth aspect, the configuration in which the projection abuts against the retaining part can decrease an area controlled by the retaining part, thereby improving a force controlled by the retaining part. Furthermore, by chamfering the corner of the projection, the risk of the retaining part engaging with the corner can be reduced when the retaining part is disposed outside the projection of the seal member.

Sixth Aspect

In the liquid ejecting head unit according to one of the first to fifth aspects, the second flow path member preferably has a projection that protrudes from the center of the second flow path to the outside thereof in the normal direction and that abuts against the retaining part. A corner of the projection which is farther from the first seal part in the stacking direction is preferably chamfered.

According to the sixth aspect, the configuration in which the projection abuts against the retaining part can decrease an area controlled by the retaining part, thereby improving a force controlled by the retaining part. Moreover, by chamfering the corner of the projection, the seal member can be easily removed from a die during a molding process.

Seventh Aspect

In the liquid ejecting head unit according to one of the first to sixth aspects, the control part is preferably aligned with the second seal part in the stacking direction.

According to the seventh aspect, the retaining part can effectively reduce the risk of the liquid leaking from the second seal part by controlling expansion of the second seal part.

Eighth Aspect

In the liquid ejecting head unit according to one of the first to seven aspects, the seal member preferably has a seal coupler disposed outside the second seal part with respect to the center of the second flow path in the normal direction. The seal coupler preferably interconnects a plurality of second seal parts.

According to the eighth aspect, the configuration in which the seal coupler interconnects the second seal parts contributes to a decreased number of components, to a reduction in overall cost, and to a simple assembly process.

Ninth Aspect

A liquid ejecting apparatus includes: the liquid ejecting head unit according to one of the first to eighth aspects; and a transport unit that transports a medium on which liquid ejected from the liquid ejecting head unit is to be placed.

According to the ninth aspect, the liquid ejecting apparatus can be assembled by a simple process and exhibits good contact performance between its components, thereby reducing the risk of liquid leaking.

BRIEF DESCRIPTION OF THE DRAWINGS

The invention will be described with reference to the accompanying drawings, wherein like numbers reference like elements.

DESCRIPTION OF EXEMPLARY EMBODIMENTS

A detailed description will be given below of some embodiments of the invention.

First Embodiment

Figure 1:
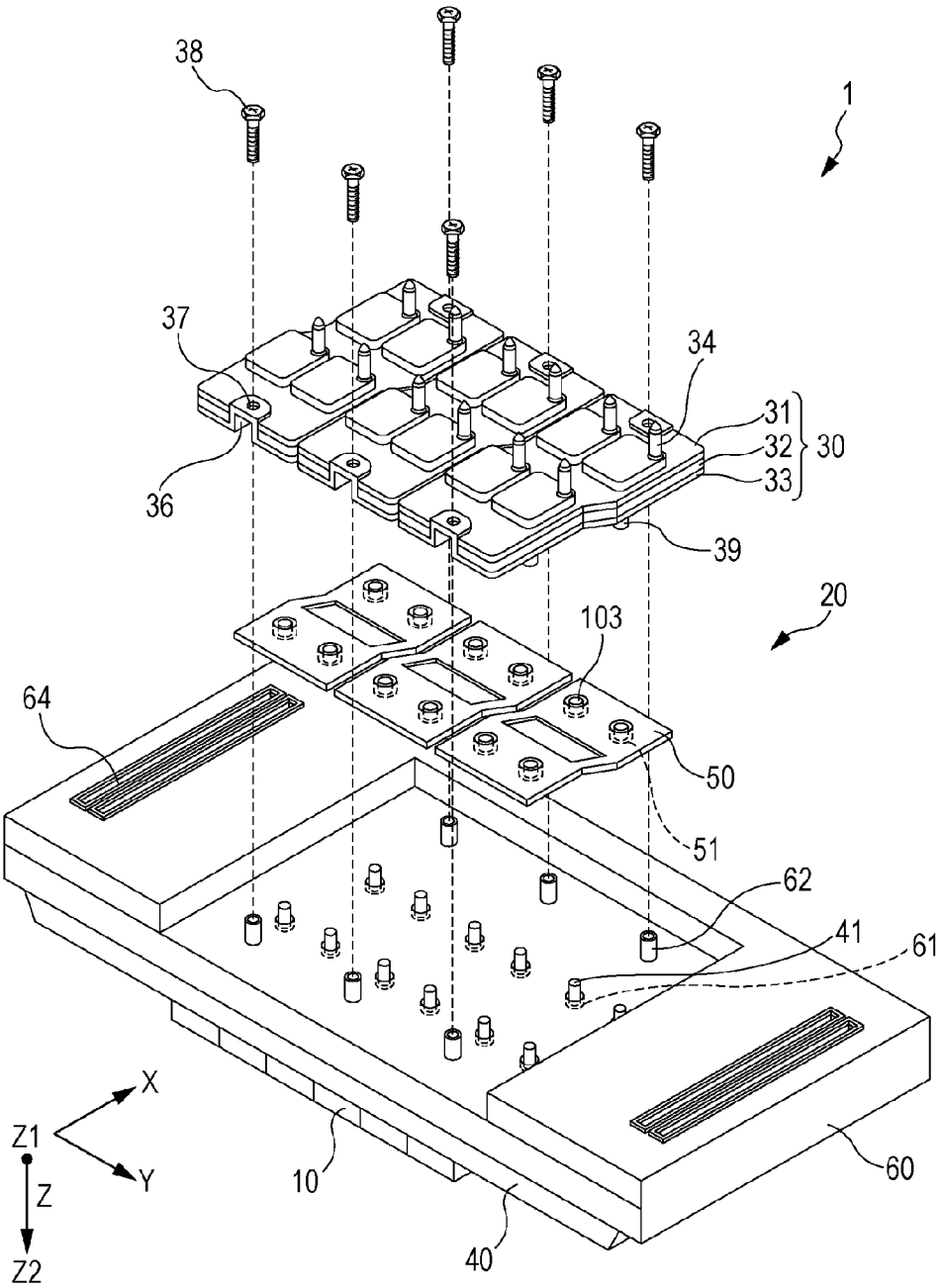
FIG. 1 is an exploded perspective view illustrating a head unit in a first embodiment of the invention.
Figure 2:
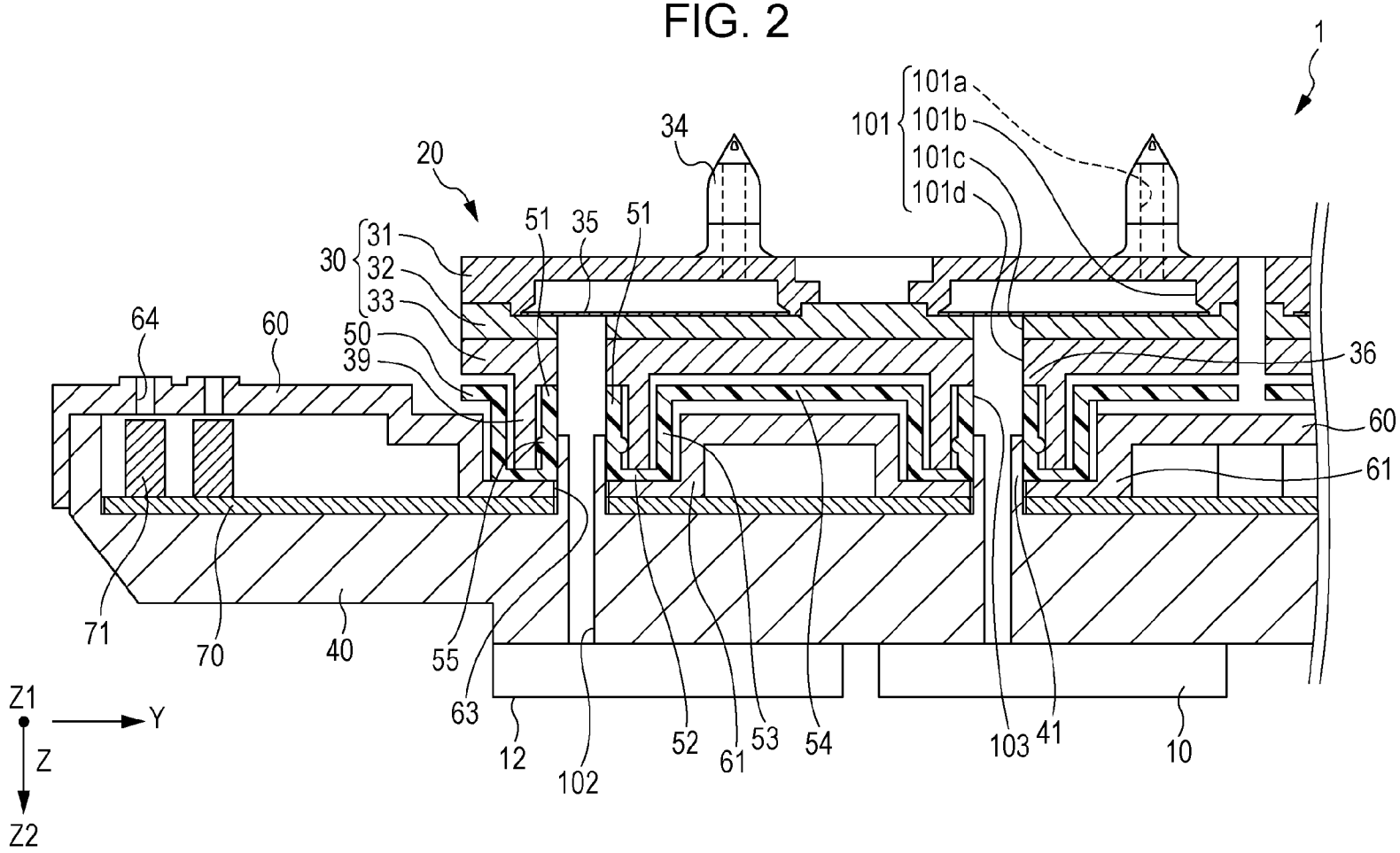
FIG. 2 is a cross-sectional view illustrating main components of the head unit.
Figure 3:
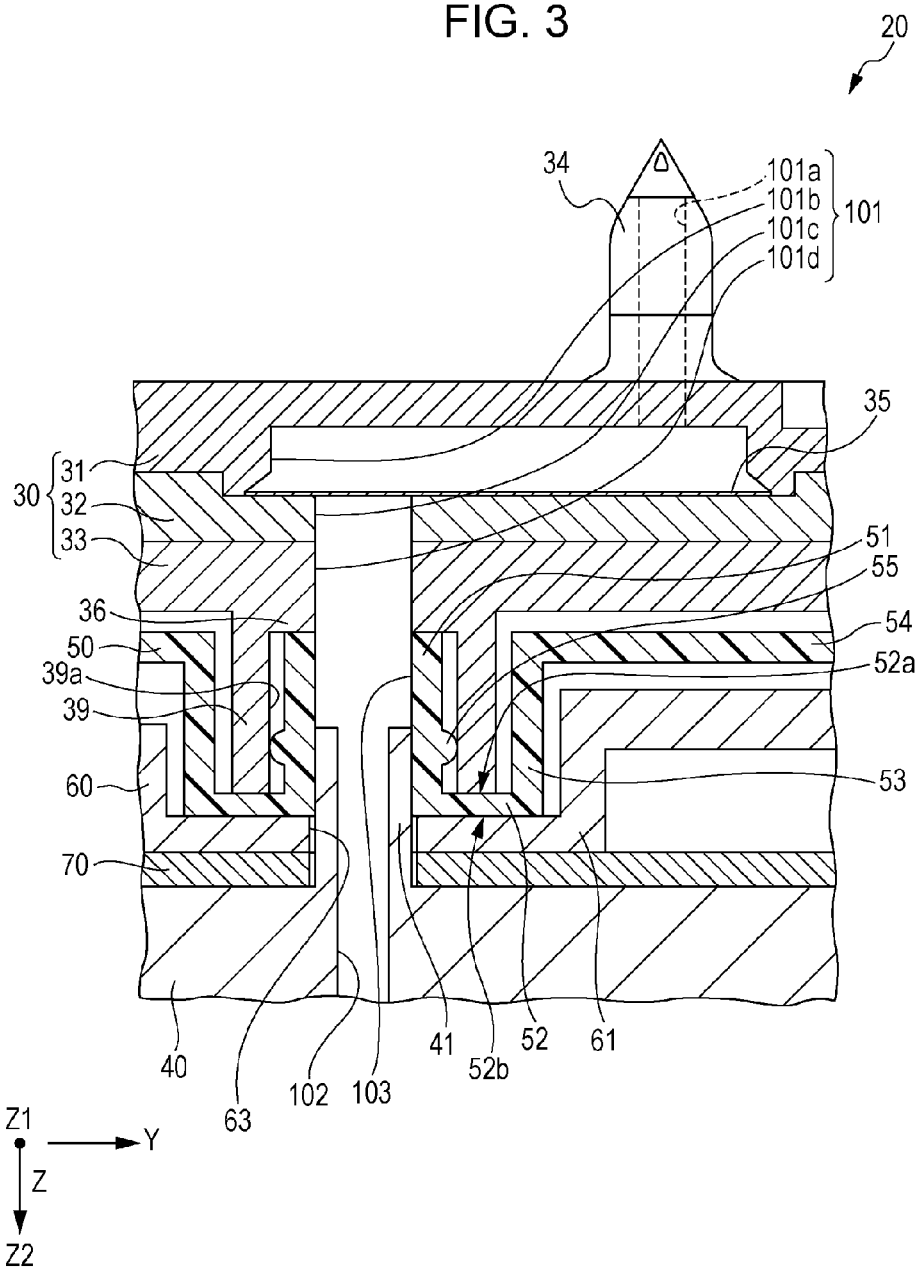
FIG. 3 is an enlarged cross-sectional view illustrating the main components of the head unit.

FIG. 1 is an exploded perspective view of an ink jet recording head unit, which is an exemplary liquid ejecting head unit in the first embodiment. FIG. 2 is a cross-sectional view illustrating the ink jet recording head unit. FIG. 3 is an enlarged cross-sectional view illustrating main components in FIG. 2.

As illustrated in the drawings, an ink jet recording head unit 1, which is an exemplary liquid ejecting head unit in the embodiments, includes: a plurality of ink jet recording heads 10 that eject ink droplets through nozzles; and a flow path member 20 that is provided with: the plurality of recording heads 10; and liquid flow paths through which liquid is supplied to the recording heads 10. Hereinafter, the ink jet recording head unit 1 is referred to as the "head unit 1" and the ink jet recording heads 10 are referred to as the "recording heads 10", as appropriate.

Each recording head 10 is provided with a liquid ejection surface 12 having open nozzles through which ink droplets are to be ejected as the liquid. Each liquid ejection surface 12 is provided with two nozzle rows (not illustrated); the nozzle rows are each made up of an array of nozzles and arranged in parallel in a direction intersecting the array of the nozzles. Herein, a direction in which the nozzles in each nozzle row are arrayed is referred to as a first direction X, whereas a direction that intersects the first direction X and in which the nozzle rows are arranged is referred to as a second direction Y.

Each recording head 10 includes, for example, flow paths and drive elements in its interior; the flow paths communicate with the nozzles and the liquid flow paths in the flow path member 20, and each of the drive elements serves as a pressure generation unit and changes the pressure applied to ink in the flow paths. As an example, each drive element may be a piezoelectric actuator made of a piezoelectric material having an electromechanical conversion function. The piezoelectric actuator is made to deform to change the volume of a flow path and consequently the pressure applied to ink in the flow path, thereby causing ink droplets to be ejected through the nozzles. As another example, the drive element may be a heating element disposed in a flow path. The heating element emits heat, generating bubbles, which causes ink droplets to be ejected through the nozzles. As yet another example, the drive element may be a so-called electrostatic actuator that generates static electricity between a diaphragm and electrodes, which deforms the diaphragm, thereby causing ink droplets to be ejected through the nozzles.

The surface of each recording head 10 opposite the liquid ejection surface 12 is fixed to the flow path member 20. The recording heads 10 are supplied with the ink from a liquid storage unit, such as an ink cartridge or an ink tank, through the flow path member 20. A plurality of recording heads 10 may be provided in the flow path member 20. In this embodiment, six recording heads 20 are arranged in the second direction Y, or in a direction in which the nozzle rows are arranged in parallel, and two recording heads 20 are arranged in the first direction X. Thus, a total of 12 parallel nozzle rows are arranged in the head unit 1 in the second direction Y. Herein, a direction in which the flow path member 20 is fixed to the recording head 10 is referred to below as a third direction Z. The direction in which the flow path member 20 is fixed to the recording head 10 corresponds to a stacking direction, which is orthogonal to in-plane directions of the liquid ejection surface 12 (including the first direction X and the second direction Y). Herein, the side of each recording head 10 which is closer to the flow path members 20 in the third direction Z is referred to as the Z1 side, whereas the side of each recording head 10 on which the liquid ejection surface 12 is formed in the third direction Z is referred to as the Z2 side.

The method of fixing the recording heads 10 to the flow path member 20 is not limited. For example, the recording heads 10 may be fixed to the flow path member 20 with a bonding agent or with screws. However, the recording heads 10 are preferably fixed to the flow path member 20 with a bonding agent. One reason is that the recording heads 10 cannot be easily fixed to the flow path member 20 with an elastic seal member therebetween due to their small size.

The flow path member 20, to which the recording heads 10 are fixed, includes a plurality of upstream flow path members 30, a downstream flow path member 40, a plurality of seal members 50, and a support member 60. Each upstream flow path member 30 is provided with upstream flow paths 101 connected to the liquid storage unit. The downstream flow path member 40 is provided with downstream flow paths 102 on the Z2 side with respect to the upstream flow path member 30; the downstream flow paths 102 communicate with corresponding upstream flow paths 101. The seal members 50 are disposed between the upstream flow path members 30 and the downstream flow path member 40 and hermetically seal the connecting parts of the upstream flow paths 101 and of the downstream flow paths 102. The support member 60 has support parts 61 that support the seal members 50. In short, the upstream flow paths 101 and the downstream flow paths 102 constitute the liquid flow paths of the flow path member 20. Herein, the upstream flow path member 30 corresponds to a first flow path member, and each upstream flow path 101 corresponds to a first flow path. The downstream flow path member 40 corresponds to a second flow path member, and each downstream flow path 102 corresponds to a second flow path.

In this embodiment, each upstream flow path member 30 includes a first upstream flow path member 31, a second upstream flow path member 32, and a third upstream flow path member 33 that are stacked in this order in the third direction Z or in the direction from the Z1 side to the Z2 side. However, each upstream flow path member 30 is not limited to this structure; each upstream flow path member 30 may be composed of an arbitrary number of members. In addition, members composing an upstream flow path member 30 may be stacked in an arbitrary direction, such as the first direction X or the second direction Y.

Each first upstream flow path member 31 has connecting parts 34 on the Z1-side surface that is farther from the downstream flow path member 40; the connecting parts 34 are connected to the liquid storage unit storing ink as the liquid. In this embodiment, each connecting part 34 may be a needle-shaped projection connected to the liquid storage unit. The connecting parts 34 may be connected either directly to the liquid storage unit, such as an ink cartridge, or indirectly thereto via a supply pipe, for example. A first upstream flow path 101*a* is formed inside each connecting part 34 and supplied with the ink from the liquid storage unit. A liquid chamber 101*b* is formed in each first upstream flow path 101*a* on its downstream side; the liquid chambers 101*b* have an inner diameter larger than that of the first upstream flow paths 101*a* in the connecting parts 34.

The second upstream flow path members 32 are fixed to the Z2-side surfaces of corresponding first upstream flow path members 31. Each second upstream flow path member 32 has second upstream flow paths 101*c* that communicate with corresponding first upstream flow paths 101*a*. In addition, filters 35 that remove bubbles and foreign matter from the ink are provided in the openings of the second upstream flow paths 101*c* in the second upstream flow path member 32. The ink supplied through both the first upstream flow paths 101*a* and the liquid chambers 101*b* passes through the filters 35 and then enters the second upstream flow paths 101*c*. A structure of the second upstream flow paths 101*c* may depend on a positional relationship between the first upstream flow paths 101*a* and the third upstream flow paths 101*d* (described later). For example, each second upstream flow path 101*c* may be a flow path that extends in the third direction Z, which is the stacking direction of the first upstream flow path member 31 and the second upstream flow path member 32. Alternatively, each second upstream flow path 101*c* may be a flow path that extends in a direction perpendicular to the third direction Z, such as one of in-plane directions including the first direction X and the second direction Y.

The third upstream flow path members 33 are fixed to the Z2-side surfaces of corresponding second upstream flow path members 32. Each third upstream flow path member 33 has third upstream flow paths 101*d* that communicate with corresponding second upstream flow paths 101*c* in a second upstream flow path member 32. In short, each upstream flow path 101 includes a first upstream flow path 101*a*, a liquid chamber 101*b*, a second upstream flow path 101*c*, and a third upstream flow path 101*d*. A first end of each third upstream flow path 101*d* which is closer to the second upstream flow path members 32 is open on the Z1-surfaces of the third upstream flow path members 33, and the third upstream flow paths 101*d* communicate with corresponding second upstream flow paths 101*c*. A second end of each third upstream flow path 101*d* which is closer to the downstream flow path member 40 is open on the Z2-surfaces of the third upstream flow path members 33. Each upstream flow path 101, which includes a first upstream flow path 101*a*, a liquid chamber 101*b*, a second upstream flow path 101*c*, and a third upstream flow path 101*d*, may have a circular, elliptic, or rectangular cross section, for example.

A first upstream flow path member 31, a second upstream flow path member 32, and a third upstream flow path member 33, across which upstream flow paths 101 are formed, are stacked and integrated with one another with a bonding agent, welding, or other similar methods. Alternatively, a first upstream flow path member 31, a second upstream flow path member 32, and a third upstream flow path member 33 may be fixed to one another with screws or cramping, or other similar methods. However, a first upstream flow path member 31, a second upstream flow path member 32, and a third upstream flow path member 33 are preferably fixed to one another with a bonding agent, welding, or other similar methods, because this fixing method can suppress ink (liquid) from leaking from the connecting parts of the first upstream flow path 101*a* to the third upstream flow path 101*d*.

Each third upstream flow path member 33 is provided with recess parts 36 that are open on the Z2-side surface. In addition, fixing holes 37 are formed so as to pass through, in a thickness direction or the third direction Z, the bottoms of the recess parts 36, namely, the surfaces of the third upstream flow path members 33 which are closer to the first upstream flow path members 31. Although described in detail later, fixing parts 62 are formed in the support member 60 so as to protrude from the Z1-side surface that faces the upstream flow path member 30. If the fixing parts 62 are inserted into the recess parts 36 and then fixing screws 38 are inserted into the fixing holes 37 and fastened to the fixing parts 62, the upstream flow path members 30 are fixed to the surface of the support member 60.

In this embodiment, each upstream flow path member 30 is provided with four connecting parts 34 and four independent upstream flow paths 101. In this embodiment, although each upstream flow path member 30 is provided with four upstream flow paths 101, there is no limitation on a configuration of the upstream flow paths 101. Alternatively, for example, an upstream flow path 101 may be formed across each connecting part 34 and branch off into two or more flow paths on the downstream side of the filter 35. Each upstream flow path member 30 is provided with two fixing holes 37, and the fixing screws 38 are inserted into the fixing holes 37 so that the upstream flow path members 30 are fixed to the support members 60. In this embodiment, three upstream flow path members 30 are provided in the head unit 1, and there is no limitation on a method of fixing the upstream flow path members 30 to the support member 60. For example, the upstream flow path members 30 may be fixed to the support member 60 with a bonding agent, instead of the fixing screws 38. In this embodiment, the upstream flow path members 30 are fixed to the support member 60 with the fixing screws 38, and thus the upstream flow path members 30 can be separated easily from the support member 60. This configuration enables only the upstream flow path members 30 to be replaced, thereby contributing to a higher fabrication yield than a configuration in which the entire flow path member 20 has to be replaced. Furthermore, since the upstream flow path members 30 can be separated easily from the support member 60, the upstream flow paths 101 and the filters 35 in the upstream flow path members 30 can be cleaned easily with a cleaning liquid. In this case, the cleaning liquid is made to flow through the upstream flow paths 101 in the direction from the downstream side to the upstream side.

Although described in detail later, retaining parts 39 are formed on the Z2-side surfaces of the upstream flow path members 30; the retaining parts 39 are formed in relation to the respective openings of the upstream flow paths 101 and protrude toward the downstream flow path member 40. Each retaining part 39 is provided with a retaining hole 39*a* that is open on the Z2-side surface and that communicates with a corresponding upstream flow path 101. Thus, the retaining parts 39 each have a cylindrical shape and protrude so as to surround the opening of a corresponding upstream flow path 101. In this embodiment, each retaining part 39 may be integrated with the third upstream flow path member 33 of a corresponding upstream flow path member 30.

The downstream flow path member 40 is fixed to the Z2-side surfaces of the upstream flow path members 30 with the seal members 50 and the support member 60 therebetween. The plurality of recording heads 10 are fixed to the Z2-side surface of the downstream flow path member 40.

The downstream flow path member 40 is provided with the downstream flow paths 102 that communicate with corresponding upstream flow paths 101 of the upstream flow path members 30. A first end of each downstream flow path 102 is open on the Z2-side surface of the downstream flow path member 40 to which the recording heads 10 are fixed. A second end of each downstream flow path 102 is open at the tip of a projecting part 41 that protrudes from the Z1-side surface of the downstream flow path member 40 toward the upstream flow path members 30. In this embodiment, each projecting part 41 may have a cylindrical shape with a circular cross section.

The seal members 50 via which the upstream flow paths 101 are connected to the downstream flow paths 102 is preferably made of an elastic material that withstands liquid, such as ink, used for the head unit 1. For example, each seal member 50 may be made of a rubber, such as an elastomer.

Each seal member 50 has pipe-shaped parts 51 corresponding to upstream flow paths 101. Each pipe-shaped part 51 contains a connecting path 103. The upstream flow paths 101 in the upstream flow path members 30 communicate with the downstream flow paths 102 in the downstream flow path member 40 via the connecting paths 103 in the pipe-shaped parts 51. More specifically, the connecting paths 103 in the pipe-shaped parts 51 have substantially the same inner diameter as the openings of the upstream flow paths 101 in the upstream flow path members 30. The outer diameter of the pipe-shaped parts 51 is larger than the inner diameter of the upstream flow paths 101. Therefore, by abutting the Z2-side surfaces of the upstream flow path members 30, on which the upstream flow paths 101 are open, against the Z1-side surfaces of the seal members 50, on which the connecting paths 103 of the pipe-shaped parts 51 are open, in the direction in which the connecting paths 103 are formed, or in the third direction Z, the upstream flow paths 101 are made to communicate with the connecting paths 103. In this case, the Z1-side ends of the pipe-shaped parts 51 in the seal members 50 each serve as a first seal part that receives a force from a corresponding upstream flow path member 30 in the direction in which the upstream flow path members 30 are stacked on the downstream flow path member 40, or in the third direction Z. The upstream flow paths 101 are connected to the connecting paths 103 while the upstream flow path members 30 press the seal members 50 in the direction in which the connecting paths 103 are formed, in the direction in which the upstream flow path members 30 are stacked on the downstream flow path member 40, or in the third direction Z.

The connecting paths 103 in the pipe-shaped parts 51 have an inner diameter smaller than the outer diameter of projecting parts 41 in the downstream flow path member 40. By inserting the projecting parts 41 in the downstream flow path member 40 into the connecting paths 103 in the pipe-shaped parts 51, the downstream flow paths 102 are connected to the connecting paths 103 in the pipe-shaped parts 51. More specifically, since the inner diameter of the connecting paths 103 is smaller than the outer diameter of the projecting parts 41, when the projecting parts 41 are inserted into the connecting paths 103, the pipe-shaped parts 51 are elastically deformed outward. As a result, the projecting parts 41 are in contact with the pipe-shaped parts 51 while the inner surfaces of the connecting paths 103 press the outer surfaces of the projecting parts 41 in directions normal to the direction in which the connecting path 103 is formed, namely, to the third direction Z, or in in-plane directions including the first direction X and the second direction Y. In this case, the parts of the pipe-shaped parts 51 in the seal member 50 which are in contact with the outer circumferential surfaces of the projecting parts 41 each serve as a second seal part. The projecting parts 41 apply a force to the second seal parts in in-plane directions, including the first direction X and the second direction Y, that are normal to the third direction Z, or in directions from the center of a corresponding downstream flow path 102 to the outside thereof. The connecting paths 103 and the downstream flow paths 102 are hermetically sealed while being pressed in the radial directions of the downstream flow paths 102.

The pipe-shaped parts 51 in the seal members 50 which hermetically seal the connecting parts of the downstream flow paths 102 in the downstream flow path members 40 and of the upstream flow paths 101 in the upstream flow path members 30 applies a force to the projecting parts 41 in radial directions of the downstream flow path 102, or in directions normal to the third direction Z. When the projecting parts 41 generate a repelling force in response to the pressing force, the seal members 50 are elastically deformed in the third direction Z that is perpendicular to in-plane directions of the liquid ejection surfaces 12, thereby suppressing the repelling force from acting on the recording heads 10. This can reduce an occurrence of disadvantages in that the recording heads 10 are separated from the flow path member 20, stacked members (not illustrated) constituting each recording head 10 are separated from one another, and the liquid ejection surfaces 12 of the recording heads 10 are warped. Consequently, it is possible to control displacements of locations at which ink droplets ejected from the nozzles are to be placed on a medium.

Each seal member 50 has a flat part 52 including a first surface 52*a* formed so as to face the upstream flow path members 30 and a second surface 52*b* formed so as to face the downstream flow path member 40; the flat part 52 continues to the end of a corresponding pipe-shaped part 51 which is closer to the downstream flow path member 40. The end of each flat part 52 which is farther from the pipe-shaped parts 51 is provided with an extending part 53 extending toward the upstream flow path members 30. The extending parts 53 have an inner diameter larger than the outer diameter of the pipe-shaped parts 51, and gaps are created between the outer surfaces of the pipe-shaped parts 51 and the inner surfaces of the extending parts 53. Although described in detail later, the retaining parts 39 are placed in the gaps between the pipe-shaped parts 51 and the extending parts 53.

The pipe-shaped parts 51 formed corresponding to the upstream flow paths 101 are integrated with one another through seal couplers 54 having a flat shape which interconnect the ends of the extending parts 53 which are closer to the upstream flow path members 30. In other words, the pipe-shaped parts 51, the flat parts 52, and the extending parts 53 which are formed in relation to the respective upstream flow paths 101 are integrated in each the upstream flow path member 30 through the seal couplers 54. In this embodiment, since each upstream flow path member 30 has four upstream flow paths 101, each seal member 50 has four pipe-shaped parts 51 integrated through a seal coupler 54. Furthermore, since the flow path member 20 has three upstream flow path members 30, the seal members 50 that are as many as the upstream flow path members 30, that is, three upstream flow path members 30 are provided. In this embodiment, the extending parts 53 are provided such that the seal couplers 54 integrate the ends of the pipe-shaped parts 51 which are closer to the upstream flow path members 30; however, there is no limitation on a method of integrating the pipe-shaped parts 51. For example, instead of providing the extending parts 53, the seal couplers 54 may be connected directly to corresponding flat parts 52. In other words, the flat parts 52 may extend in the in-plane directions so as to integrate the pipe-shaped parts 51.

When the Z2-side surfaces of the upstream flow path members 30 on which the upstream flow paths 101 are open abut, in the third direction Z at a predetermined force, against the Z1-side ends of the pipe-shaped parts 51 in the seal member 50 through the connecting parts between the upstream flow paths 101 and the connecting paths 103, the pipe-shaped parts 51 in the seal members 50 are elastically deformed in the third direction Z. To prevent this deformation, in this embodiment, the support member 60 is provided on the surface of the downstream flow path member 40 which is closer to the upstream flow path members 30. Providing the support member 60 in this manner can control deformation of the pipe-shaped parts 51 in the seal member 50 in the third direction Z. More specifically, the support member 60 is provided with the support parts 61 that support the pipe-shaped parts 51. These support parts 61 abut against the Z2-side ends of the pipe-shaped parts 51 in the seal member 50 which is farther from the Z1-side ends abutting against the upstream flow path members 30, thereby controlling movement of the pipe-shaped parts 51 on the third direction Z.

The support parts 61 each have a depressed shape and are open on the Z1-side surface of the support member 60. The inner diameter of the support parts 61 is somewhat larger than the outer diameter of the extending parts 53. Therefore, the flat parts 52 of the seal members 50 can be inserted into the support parts 61 in the third direction Z.

A projecting part insertion hole 63 is formed in the third direction Z across the bottom of each support part 61. The inner diameter of the projecting part insertion holes 63 is somewhat larger than the outer diameter of the projecting parts 41 in the downstream flow path member 40 and is smaller than the outer diameter of the extending parts 53 in the seal member 50.

When the flat parts 52 in the seal members 50 are inserted into the support parts 61 in the third direction Z, the second surfaces 52*b* in the flat parts 52 which are closer to the downstream flow path member 40 abut against the bottoms of the support parts 61. In this way, movement of the second surfaces 52*b* in the inserting direction, or in the third direction Z, is suppressed. In this embodiment, the upstream flow path members 30 abut against the Z1-side ends of the pipe-shaped parts 51 in the seal members 50 in the third direction Z, thereby hermetically sealing the connecting parts of the upstream flow paths 101 and of the connecting paths 103. Further, the second surfaces 52*b* of the flat parts 52 provided on the Z2-side surfaces of the pipe-shaped parts 51 abuts against the Z1-side bottoms of the support parts 61. As a result, the upstream flow path members 30 are supported by the support member 60. By fixing the upstream flow path members 30 to the support member 60, a repelling force generated by the seal members 50 due to their elastic deformation is received by the support parts 61 in the support member 60 when the pipe-shaped parts 51 in the seal members 50 press the downstream flow path member 40. This reduces the repelling force generated by the seal members 50 which is applied to the downstream flow path member 40, thereby abutting the upstream flow path members 30 against the seal members 50 in the third direction Z at a predetermined force.

A region where the upstream flow path member 30 press the Z1-side end of the pipe-shaped part 51 for hermetically sealing, that is a region where the upstream flow path member 30 and the seal member 50 abut against each other, can be named a first region. A region where the second surface 52*b* of the flat part 52 in the seal member 50 and the support part 61 abut against each other for supporting can be named a second region. These first and second regions are preferably positioned so as to be aligned with one another as viewed from the third direction Z. In this case, the pipe-shaped parts 51 pressed by the upstream flow path members 30 are supported by the support parts 61 in the third direction Z. This configuration suppresses the pipe-shaped parts 51 from being distorted or deformed in the first direction X and the second direction Y. Consequently, it is possible to suppress distortion or deformation of the pipe-shaped parts 51, thereby reducing the risk of the ink leaking from the connecting parts of the upstream flow paths 101 and of the connecting path 103.

When hermetically sealing the connecting parts of the upstream flow paths 101 in the upstream flow path members 30 and of the downstream flow paths 102 in the support member 60, the seal members 50 receive a force from the upstream flow path members 30 in the flow direction of the ink, or in the third direction Z. In this embodiment, however, the force that the upstream flow path members 30 apply to the seal members 50 in the third direction Z is received by the support parts 61 that support the second surfaces 52*b* of the seal members 50. The support member 60 is fixed to the downstream flow path member 40 such that the fixed area of the support member 60 does not overlap both the downstream flow path member 40 and the nozzles, as viewed from the third direction Z. In this case, a predetermined space is reserved between the support parts 61 and the downstream flow path member 40. Therefore, the force that the upstream flow path members 30 apply to the seal member 50, namely, a repelling force generated by the seal members 50 due to their elastic deformation is received by the support parts 61. Then, the repelling force is dispersed through both the support member 60 with the support parts 61 and the downstream flow path member 40 fixed to the support member 60. This reduces the force applied to the seal members 50 from being transferred to, especially region around the nozzles of the recording heads 10. In addition, as described above, no force is applied, in the third direction Z, to the connecting parts of the connecting paths 103 in the seal member 50 and of the downstream flow paths 102 in the downstream flow path member 40. This suppresses force applied to the seal parts of the connecting paths 103 via which the upstream flow paths 101 are connected to the downstream flow paths 102 from being transferred to the recording heads 10. Consequently, it is possible to reduce the risk of disadvantages occurring. Examples of such disadvantages include: an event in which members constituting the recording heads 10 are separated from one another; an event in which the recording heads 10 are separated from the flow path member 20; and an event in which warping of the liquid ejection surfaces of the recording heads 10 displaces locations at which ink droplets are to be placed on a medium.

When the upstream flow path members 30 connects to the seal members 50, the upstream flow path members 30 and the seal members 50 receive a force in the flow direction of the ink, or in the third direction Z. This helps position the upstream flow path members 30 relative to the seal members 50 and make a connection therebetween. For example, upstream flow paths are formed in cylindrical projecting parts, similar to the downstream flow paths 102. Then, when upstream flow paths connect to connecting paths, pipe-shaped parts of seal members are fit to the outer circumferential surfaces of the cylindrical projecting parts. In this case, since the pipe-shaped parts need to be fit to the cylindrical projecting parts at the same time, this process may be difficult to perform. Furthermore, since the connecting parts of the upstream flow path members and the seal members are hidden by a support member and other members, a manufacturer may fail to visually check the connecting parts accurately. If any positional errors arise between the cylindrical projecting parts and the pipe-shaped parts, a manufacturer needs to bend the pipe-shaped parts, in which case the cylindrical projecting parts may be in poor contact with the pipe-shaped parts, risking an ink leakage. In this embodiment, however, when the upstream flow paths 101 are made to communicate with the connecting paths 103, the flat surfaces of the upstream flow path members 30 abut against the flat surfaces of the seal members 50 in the third direction Z at a predetermined force. This configuration can eliminate the need to visually check the relative position between the upstream flow path members 30 and the seal members 50. Even if any positional errors arise between the upstream flow paths 101 and the pipe-shaped parts 51, a force applied to the pipe-shaped parts 51 in a direction in which the pipe-shaped parts 51 are bent decreases, thereby reducing the risk of ink leaking due to poor contact.

The outer circumferential surfaces of the pipe-shaped parts 51 in the seal members 50 via which the upstream flow paths 101 are connected to the downstream flow paths 102 are each provided with a projection 55. The projections 55 abut against the retaining parts 39 of the upstream flow path members 30. The projection 55 is continuously formed on the outer circumferential surface of each pipe-shaped part 51. Alternatively, the projection 55 may be discontinuously formed on the outer circumferential surface of each pipe-shaped part 51. The projections 55 are preferably formed so as to oppose the region in in-plane directions, including the first direction X and the second direction Y, in which the inner circumferential surfaces of the pipe-shaped parts 51 are in contact with the outer circumferential surface of corresponding projecting parts 41 of the downstream flow path member 40. Herein, although described in detail later, the projections 55 serve as control parts that control expansion of the pipe-shaped parts 51 by abutting against the retaining parts 39 within the regions in which the pipe-shaped parts 51 are in contact with the projecting parts 41. Forming the projections 55 in this manner can reliably reduce the risk of ink leaking due to poor contact. Alternatively, the projections 55 may be formed outside the regions in which the pipe-shaped parts 51 are in contact with the projecting parts 41 and within regions closer to the upstream flow path members 30. Even in this case, the projections 55 can also reduce expansion of the pipe-shaped parts 51. However, by providing the projections 55 within the regions in which the pipe-shaped parts 51 are in contact with the projecting parts 41, decrease in the adhesion between the pipe-shaped parts 51 and the projecting parts 41 can be more reliably controlled when the pipe-shaped parts 51 expand. For this reason, the projections 55 are preferably formed so as to oppose the regions in which the inner circumferential surfaces of the pipe-shaped parts 51 are in contact with the outer circumferential surfaces of the projecting parts 41 in the downstream flow path member 40.

The corner of each projection 55 which is closer to the upstream flow path members 30 in the third direction Z, or the corner of each projection 55 on the Z1 side, may be chamfered. The chamfered corner of each projection 55 may be either angled or rounded; however, the chamfered corner is preferably rounded. One reason is that when a retaining part 39 is fit to the outer circumferential surface of a corresponding pipe-shaped part 51, the end of the retaining part 39 is less likely to engage with the corner of the projection 55 which is closer to the upstream flow path members 30, thereby reducing the risk, for example, that the pipe-shaped part 51 is deformed and the retaining part 39 fails to fit to the outer circumferential surface of the pipe-shaped part 51. In this embodiment, the corner of each projection 55 which is closer to the downstream flow path member 40 in the third direction Z, or the corner of each projection 55 on the Z2 side, may also be chamfered. The chamfered corner of each projection 55 on the Z2 side may be either angled or rounded. By chamfering the corner of each projection 55 which is closer to the downstream flow path member 40, the seal members 50 can be easily removed from a die when the seal members 50 are molded. This leads to a simple manufacturing process. Obviously, either one or both of the Z1-side and Z2-side corners of each projection 55 necessarily have to be chamfered. In this embodiment, since both the Z1-side and Z2-side corners of each projection 55 are subjected to round chamfering, the cross section of each projection 55 in the third direction Z has a semicircular shape.

Each upstream flow path member 30 is provided with the retaining parts 39 in relation to the respective openings of its upstream flow paths 101; the retaining parts 39 protrude from the Z2-side surface toward the downstream flow path member 40. Each retaining part 39 has a cylindrical shape and has a Z2-side surface on which the retaining hole **39*a* is open. The retaining parts 39 are inserted, from the Z1 side, into the recesses between the pipe-shaped parts 51 of the seal members 50 and of the extending parts 53. The retaining parts 39 have an outer diameter somewhat smaller than the inner diameter of the extending parts 53. The retaining parts 39 are placed on the outer circumferential surfaces of corresponding pipe-shaped parts 51 so as to surround the regions in which the inner circumferential surfaces of the pipe-shaped parts 51 are in contact with the outer circumferential surfaces of the projecting parts 41 in the downstream flow path member 40. Moreover, in this embodiment, the retaining parts 39 may at least extend such that their ends abut against the projections 55 formed in the pipe-shaped parts 51 in the seal member 50, that is, their ends are aligned with the projections 55** in the third direction Z.

In this embodiment, the inner diameter of the retaining holes **39*a* in the retaining parts 39 is somewhat smaller than the outer diameter of the projections 55 of the pipe-shaped parts 51. Therefore, the inner surfaces of the retaining holes 39*a* in the retaining parts 39 are in contact with the surfaces of the projections 55. In other words, the inner surfaces of the retaining holes 39*a* are in contact with the outer circumferential surfaces of corresponding pipe-shaped parts 51 including the surfaces of the projections 55. Even when the pipe-shaped parts 51 do not expand, the inner surfaces of the retaining holes 39*a* in the retaining parts 39 keep contact with the outer circumferential surfaces of corresponding pipe-shaped parts 51. Thus, this configuration can control decrease in the adhesion between the pipe-shaped parts 51 and the projecting parts 41. However, the inner circumferential surfaces of the retaining holes 39*a* in the retaining parts 39 necessarily do not have to keep contact with the outer circumferential surfaces of corresponding pipe-shaped parts 51 including the surfaces of the projections 55. More specifically, only when the pipe-shaped parts 51 expand in response to application of pressure to the ink, the inner circumferential surfaces of the retaining holes 39*a* in the retaining parts 39 may be in contact with the outer circumferential surfaces of corresponding pipe-shaped parts 51 including the surfaces of the projections 55. If the inner circumferential surfaces of the retaining holes 39*a* in the retaining parts 39 do not keep contact with the outer circumferential surfaces of corresponding pipe-shaped parts 51, a weaker force acts on the pipe-shaped parts 51 in the third direction Z when the retaining parts 39 are placed around corresponding pipe-shaped parts 51. It should be noted that the retaining holes 39*a* in the retaining parts 39 may be in either surface or partial contact with corresponding pipe-shaped parts 51, including the projections 55, within the region in which the retaining parts 39 oppose the pipe-shaped parts 51. In this embodiment, the entire inner circumferential surfaces of the retaining holes 39*a* in the retaining parts 39 are in contact with the projections 55 protruding from the outer circumferential surfaces of corresponding pipe-shaped parts 51. Obviously, no projections 55 have to be formed, and the inner circumferential surfaces of the retaining holes 39*a* in the retaining parts 39 may be in contact with the outer circumferential surfaces of corresponding pipe-shaped parts 51. However, by forming the projections 55 so as to make contact with the inner circumferential surfaces of the retaining holes 39***a* in the retaining parts 39, forces that the retaining parts 39 apply to the pipe-shaped parts 51 in order to reduce expansion of the pipe-shaped parts 51 can be concentrated in the projections 55. Thus, the configuration in which the projections 55 are in contact with the inner circumferential surfaces of the retaining holes 39*a* successfully reduces the risk that the ink leaks more appropriately than the configuration in which the entire inner circumferential surfaces of the retaining holes 39*a* are in contact with the outer circumferential surfaces of the pipe-shaped parts 51. In this embodiment, the projections 55 are formed on the outer circumferential surfaces of the pipe-shaped parts 51 in the seal member 50; however, there is no limitation on a configuration of the projections 55. Alternatively, for example, the projections 55 may be formed on the inner circumferential surfaces of the retaining holes 39*a* in the retaining part 39. The inner diameter of the retaining holes 39*a* in the retaining parts 39, or the inner diameter of the control parts that control expansion of the pipe-shaped parts 51, is larger than the outer diameter of the Z1-side ends of the pipe-shaped parts 51, or the outer diameter of the first seal parts. Thus, the outer diameter of the first seal parts is included in the inner diameter of the retaining holes 39*a* of corresponding retaining parts 39, as viewed from the third direction Z. Therefore, when the retaining parts 39 are moved in the third direction Z relative to corresponding seal members 50 in order to be removed from the seal members 50, the first seal parts in the seal member 50 do not interfere with the movement of the retaining parts 39.

As described above, the projections 55 in the seal members 50 control expansion of the pipe-shaped parts 51 by abutting against corresponding retaining parts 39. Further, the projections 55 are preferably positioned so as to oppose the regions in in-plane directions, including the first direction X and the second direction Y, in which the inner circumferential surfaces of the pipe-shaped parts 51 in the seal members 50 abut against the outer circumferential surfaces of the projecting parts 41 in the downstream flow path member 40. This configuration reliably presses the contact parts between the pipe-shaped parts 51 and the projecting parts 41 by using the projections 55, which abut against the retaining parts 39 as the control parts. Consequently, it is possible to reliably reduce expansion of the pipe-shaped parts 51, thereby controlling decrease in the adhesion between the pipe-shaped parts 51 and the projecting parts 41. Since the flat parts 52 are continuously formed at the Z2-side ends of the pipe-shaped part 51 in each seal member 50, the control parts through which the retaining parts 39 abut against the pipe-shaped parts 51 are formed closer to the first surfaces 52*a* of the flat parts 52. Therefore, the flat parts 52 can be placed without interfering with the control parts through which the projecting parts 41 are in contact with the pipe-shaped parts 51. More specifically, pipe-shaped parts 51 are fit to the projecting parts 41 and then the seal members 50 are connected to the upstream flow path members 30. Therefore, if the flat parts 52 are continuously formed at the Z1-side ends of the pipe-shaped parts 51, the flow path member 20 may be difficult to assemble, because the flat parts 52 and the control parts interfere with each other.

Figure 4:
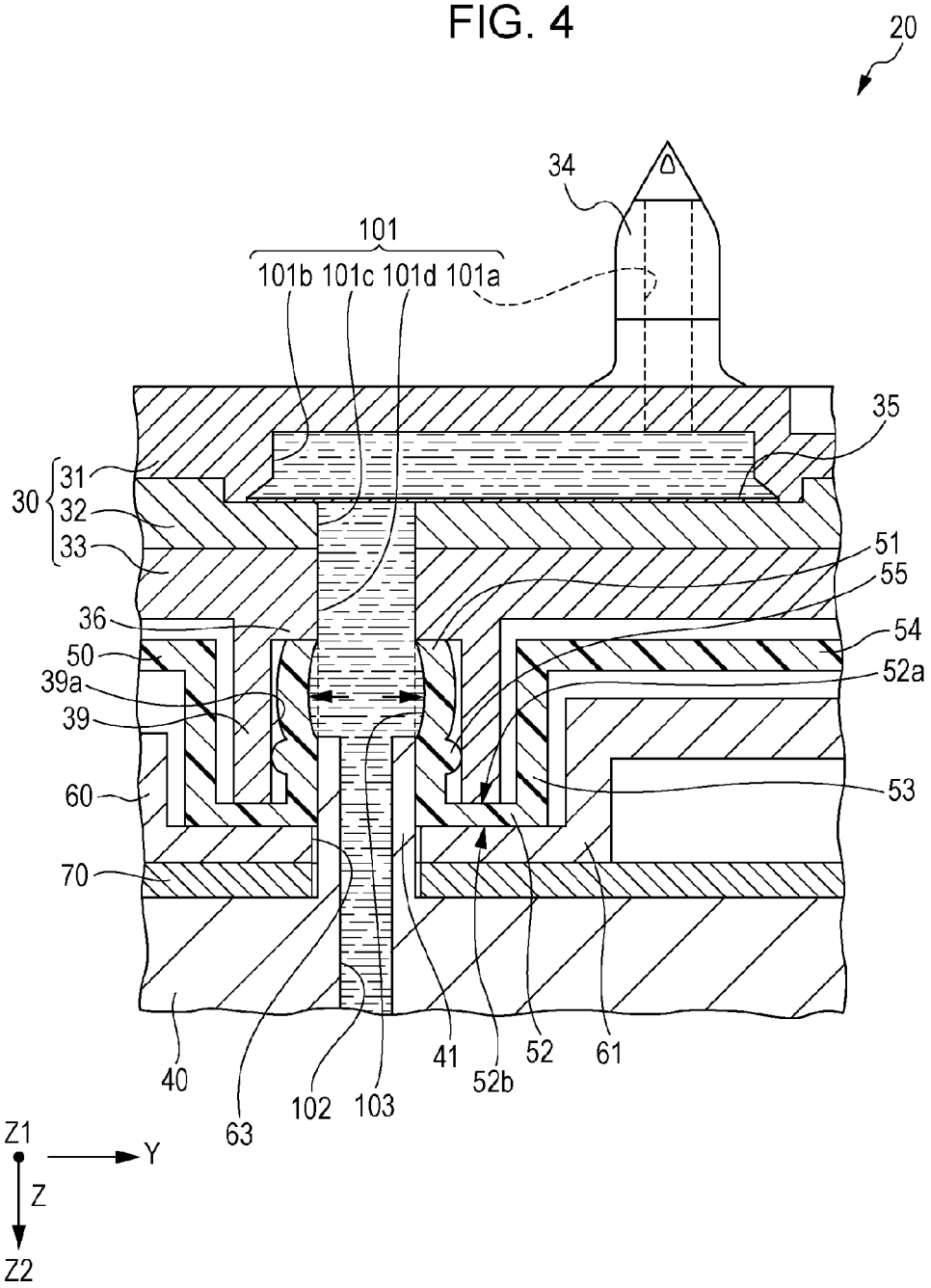
FIG. 4 is an enlarged cross-sectional view illustrating the main components of the head unit.

When pressure is applied to the ink in a flow path in the flow path member 20, as illustrated in FIG. 4, the ink expands a pipe-shaped part 51 in a seal member 50. In this case, a retaining part 39 controls the expansion of a part of the pipe-shaped part 51 in which a projection 55 abutting against the retaining part 39 is formed. The part of the pipe-shaped part 51 in which the projection 55 abutting against the retaining parts 39 is formed serves as a control part that controls the expansion of the pipe-shaped part 51. When pressure is applied to the ink, the retaining part 39 reduces expansion of the control part in the pipe-shaped part 51. In this way, the retaining parts 39 reduce expansion of the pipe-shaped parts 51, thereby controlling decrease in the adhesion between the inner circumferential surfaces of the pipe-shaped parts 51 and the outer circumferential surfaces of the projecting parts 41. Consequently, it is possible to reduce the risk of the ink leaking from the connecting parts of the connecting paths 103 and downstream flow paths 102. In this embodiment, the control parts through which the retaining parts 39 control expansion of the pipe-shaped parts 51 are positioned within the regions opposing the contact parts of the pipe-shaped parts 51 and the projecting parts 41. Therefore, the retaining parts 39 can directly control expansion of parts of the pipe-shaped parts 51 which are in contact with the projecting parts 41, thereby reliably controlling decrease in the adhesion between the inner circumferential surfaces of the pipe-shaped parts 51 and the outer circumferential surfaces of the projecting parts 41.

In this embodiment, the retaining parts 39 that control expansion of the pipe-shaped parts 51 are provided outside the pipe-shaped parts 51. Providing the retaining parts 39 in this manner permits the pipe-shaped parts 51 to make contact with corresponding projecting parts 41 at a weak force before the retaining parts 39 are placed during an assembly process, and then also permits the pipe-shaped parts 51 to be fit to the outer circumferential surfaces of corresponding projecting parts 41 at a weak force. If no retaining parts are provided, pipe-shaped parts need to make contact with corresponding projecting parts at a strong force in order to reduce leakage of the ink to which pressure is applied. However, bringing the pipe-shaped parts into contact with corresponding projecting parts at a strong force may complicate an assembly process and deform the pipe-shaped parts. Moreover, if the pipe-shaped parts are integrally formed in each seal member as in this embodiment, it is difficult to simultaneously fit the pipe-shaped parts to the projecting parts at a strong force. In contrast, this embodiment permits the pipe-shaped parts 51 to make contact with corresponding projecting parts 41 at a weak force, and thus also permits the pipe-shaped parts 51 to be fit to the outer circumferential surfaces of corresponding projecting parts 41 at a weak force. Consequently, it is possible to assemble the flow path member 20 through a simple process and to reduce deformation of the pipe-shaped parts 51. Furthermore, by pressing the retaining parts 39 against the outer circumferential surfaces of corresponding pipe-shaped parts 51 after the pipe-shaped parts 51 have been fit to the outer circumferential surfaces of the projecting parts 41, the adhesion between the pipe-shaped parts 51 and the projecting parts 41 can be enhanced. This further reduces the risk of ink leaking.

To apply pressure to the ink in the flow paths, a booster pump may be provided close to the liquid storage unit, or the water head difference between the liquid storage unit and the head unit 1 may be utilized.

In this embodiment, the retaining parts 39 protrude beyond the projections 55 toward the downstream flow path member 40. Then, the ends of the retaining parts 39 abut against the first surfaces 52*a* of the flat parts 52. In other words, the ends of the retaining parts 39 serve as abutting parts that abut against the first surfaces 52*a* of the flat parts 52. Thus, by fitting the pipe-shaped parts 51 in the seal members 50 to the projecting parts 41 in the downstream flow path member 40, the ends of the retaining parts 39 can be pressed onto the first surfaces 52*a* of the flat parts 52 in the third direction Z, or toward the downstream flow path member 40.

Figure 5:
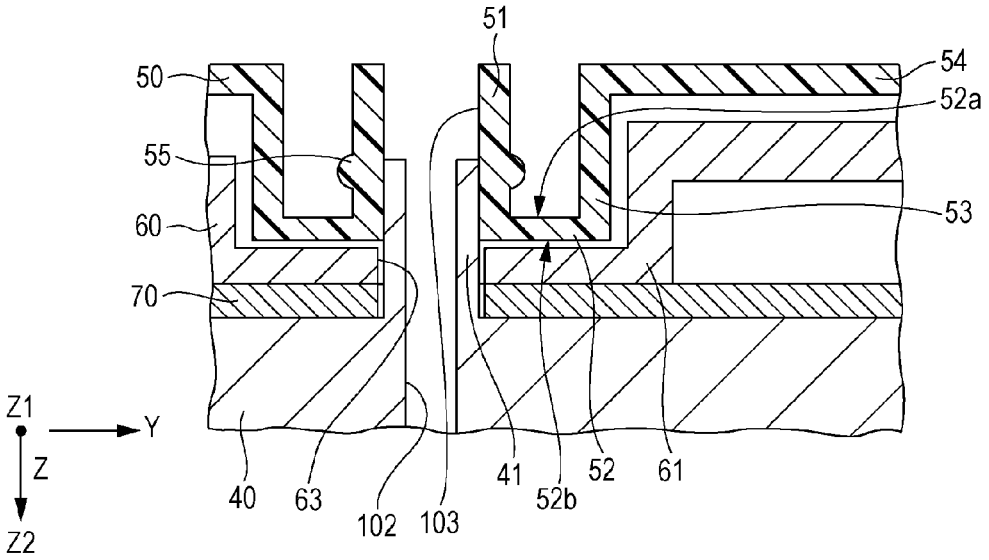
FIG. 5 is a cross-sectional view illustrating the main components, which is used to describe a method of manufacturing the head unit.
Figure 6:
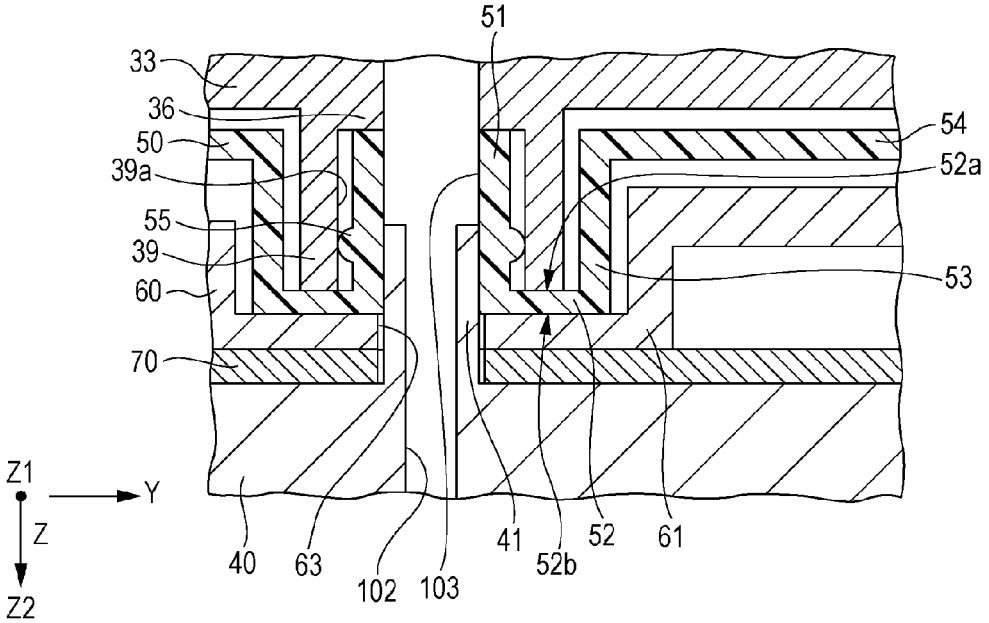
FIG. 6 is a cross-sectional view illustrating the main components, which is used to describe a method of manufacturing the head unit.

Next, a method of manufacturing the head unit 1 will be described with reference to FIGS. 5 and 6. FIGS. 5 and 6 are cross-sectional views illustrating the main components, which are used to describe a method of manufacturing the head unit 1.

As illustrated in FIG. 5, the support member 60 is fixed to the downstream flow path member 40, and then the pipe-shaped parts 51 in the seal members 50 are fit to corresponding projecting parts 41 in the downstream flow path member 40. In this case, some pipe-shaped parts 51 may float over a desired location. This is because when a pipe-shaped part 51 is fit to a corresponding projecting part 41, there are cases where the projecting part 41 is insufficiently inserted into the pipe-shaped part 51 and where the pipe-shaped part 51 is deformed when compressed in the third direction Z. Moreover, when the pipe-shaped part 51 is fit to the outer circumferential surface of the projecting part 41, stress generated when the pipe-shaped part 51 has been compressed in the third direction Z may remain and act on the downstream flow path member 40 in the third direction Z.

To prevent the above disadvantages, as illustrated in FIG. 6, the upstream flow path members 30 are fixed to the support member 60. As described above, as viewed from the third direction Z, the outer diameter of a first seal part, which is a Z1-side end of the pipe-shaped part 51 in the seal member 50, is included in the inner diameter of a retaining part 39, and a flat part 52 is formed on the Z2-surface of the pipe-shaped part 51. The retaining part 39 thereby can be inserted into the gap between the pipe-shaped part 51 and an extending part 53 in the third direction Z. Therefore, in the process illustrated in FIG. 5, it is only necessary to fit the pipe-shaped part 51 to the projecting part 41. This makes it possible to connect the projecting part 41 to the pipe-shaped part 51 without difficulty and to reduce the risk of the pipe-shaped part 51 being bent or deformed. In contrast, for example, if the retaining parts 39 are integrated with the downstream flow path members 40 or provided between the seal members 50 and the downstream flow path member 40, it is necessary to simultaneously connect the pipe-shaped parts 51 in the seal members 50 to the projecting parts 41 and the pipe-shaped parts 51 to the retaining parts 39. This increases the risk of the pipe-shaped parts 51 being deformed inhibits the above connections from being made appropriately.

The retaining parts 39 are inserted into the gaps between the pipe-shaped parts 51 and the extending parts 53 with the abutting parts abutting against the first surfaces 52*a* of the flat parts 52 and pressing, in the third direction Z, the pipe-shaped parts 51 that might float from the projecting parts 41. This reduces positional shifts of the pipe-shaped parts 51 from the projecting parts 41 and deformation of the pipe-shaped parts 51 when the pipe-shaped parts 51 are fit to corresponding projecting parts 41. In addition, the pipe-shaped parts 51 that would be compressed in the third direction Z can stretch in the third direction Z, thereby reducing stress remaining in the projecting parts 41. Thus, it is possible to reduce the risk of ink leaking by reserving a sufficiently large area in which the pipe-shaped parts 51 are in contact with the projecting parts 41 and by ensuring good contact therebetween even when the pipe-shaped parts 51 are deformed and to suppress remaining stresses from affecting the liquid ejection surfaces 12.

In this embodiment, when the flow path member 20 is assembled, the support member 60, the seal members 50, the retaining parts 39, and the upstream flow path members 30 are stacked on the downstream flow path member 40 in the third direction Z, or in the same direction. This configuration protects the seal member 50 from receiving forces at the same time when the projecting parts 41, the retaining parts 39, and the upstream flow path members 30 are fixed to the pipe-shaped parts 51 in the seal members 50. Consequently, it is possible to reduce the risk of the seal members 50 being bent or deformed and to assemble the flow path member 20 by using a simple process, thus leading to a short-time assembly process and a reduction in overall cost.

In this embodiment, a wiring substrate 70 is disposed between the downstream flow path member 40 and the support member 60. Although not illustrated in the drawings, the wiring substrate 70 is provided with wires connected to the pressure generation units in the recording heads 10 and other components. The wiring substrate 70 has a connector 71, to which external wires (not illustrated) are connected via a wire connecting hole 64 formed in the support member 60. When the wiring substrate 70 is disposed in the flow path member 20 as described above, it is necessary to reduce the risk of ink (liquid) leaking from the connecting parts of the upstream flow paths 101 and of the downstream flow paths 102. This is because if ink is brought into contact with the wiring substrate 70, the wires in the wiring substrate 70 may be short-circuited. Therefore, in this embodiment, the seal members 50 are used to seal the connecting parts of the upstream flow paths 101 and the downstream flow paths 102, and the retaining parts 39 are provided. Consequently, it is possible to hermetically seal the connecting parts of the upstream flow paths 101 and of the downstream flow paths 102 while reducing forces applied to the recording heads 10 in the third direction Z.

As described above, in this embodiment, the downstream flow paths 102 communicate with corresponding connecting paths 103 via the seal members 50, and the seal members 50 hermetically seal the connecting parts of the upstream flow paths 101 and of the downstream flow paths 102 while applying forces to the downstream flow path 102 in radial directions. The upstream flow paths 101 are connected to corresponding connecting paths 103 via the seal members 50, and the seal members 50 receives a force from the upstream flow path 101 in the third direction Z. Furthermore, the support parts 61 in the support member 60 control movement of the seal members 50 in the third direction Z. This reduces a force applied to the recording heads 10 in the third direction Z, which is perpendicular to in-plane directions of the liquid ejection surface 12. Consequently, it is possible to reduce occurrences of disadvantages, for example, in that the recording heads 10 are separated from the flow path member 20, stacked members (members stacked in the third direction Z) in the recording heads 10 are separated from one another, and warping of the liquid ejection surfaces 12 in the recording heads 10 displaces locations at which ink droplets ejected from the nozzles are to be placed on a medium. Moreover, since the upstream flow path members 30 abut against the seal members 50 in the third direction Z, it is possible to help position the upstream flow path members 30 relative to the seal members 50 fixed to the downstream flow path member 40 and connect the upstream flow path members 30 to the seal members 50.

To control expansion of the pipe-shaped parts 51 in the seal members 50, the retaining parts 39 are provided on the outer circumference of the pipe-shaped parts 51. Providing the retaining parts 39 in this manner successfully reduces the risk of leakages of the ink to which pressure is applied.

Second Embodiment

Although the first embodiment of the invention has been described, a fundamental configuration of the invention is not limited to that of the first embodiment.

Figure 7:
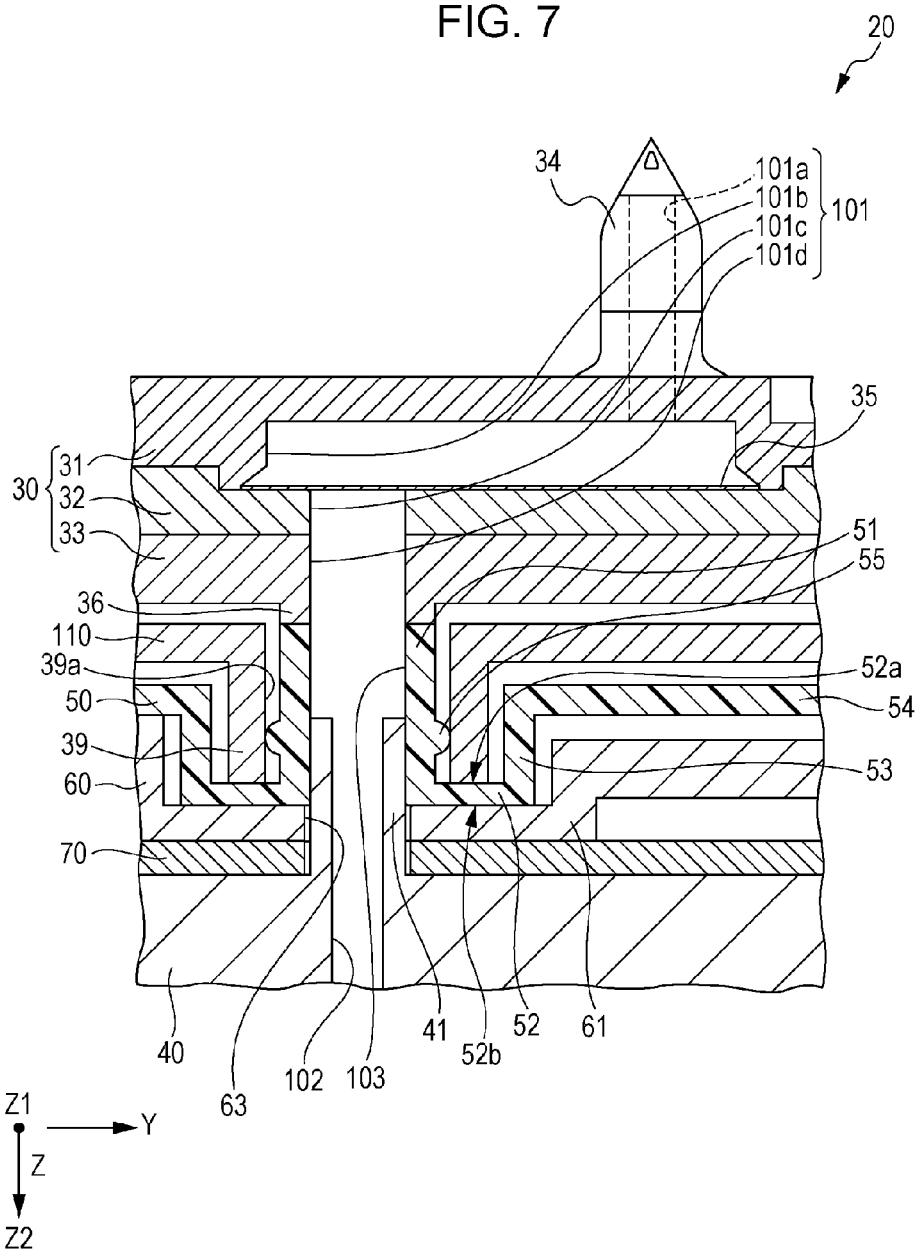
FIG. 7 is an enlarged cross-sectional view illustrating main components of a head unit in a second embodiment of the invention.

For example, in the first embodiment, the retaining parts 39 are integrally provided in the upstream flow path members 30; however, there is no limitation on a configuration of the retaining parts 39. A modification of the retaining parts 39 is illustrated in FIG. 7. FIG. 7 is an enlarged cross-sectional view illustrating main components of a head unit in a second embodiment of the invention.

As illustrated in FIG. 7, a retaining part 39 is provided in a retaining member 110, which is a member independent of an upstream flow path member 30. The retaining member 110 is disposed between the upstream flow path member 30 and a seal member 50 so as not to interfere with a first seal part, via which an upstream flow path 101 in the upstream flow path member 30 is connected to a connecting path 103 in the seal member 50. This configuration is also effective in reducing expansion of the seal members 50 by using the retaining parts 39 so as to control ink leakages, similar to the foregoing first embodiment.

In the foregoing first embodiment, the plurality of pipe-shaped parts 51 are integrally provided in each seal member 50; however, there is no limitation on a configuration of the pipe-shaped parts 51. Alternatively, independent pipe-shaped parts 51 may be provided in relation to respective upstream flow paths 101. In this case, flat parts 52 may be formed in relation to the respective pipe-shaped parts 51, and flat parts 52, extending parts 53, and seal couplers 54 do not necessarily have to be provided.

In the foregoing first embodiment, the retaining parts 39 are continuously formed on the outer circumferences of the pipe-shaped parts 51; however, there is no limitation on a configuration of the retaining parts 39. Alternatively, retaining parts 39 may be discontinuously formed on the outer circumferences of the pipe-shaped parts 51. More specifically, each retaining part 39 may have an outer circumference on which slits are formed at predetermined intervals. Thus, the expression the retaining parts 39 are provided on the outer circumferences of the pipe-shaped parts 51" implies that the retaining parts 39 are continuously or discontinuously provided on the outer circumferences of the pipe-shaped parts 51.

The foregoing first embodiment provides the support member 60 equipped with the support parts 61; however, the support member 60 does not necessarily have to be provided. In this case, a force that the upstream flow path members 30 apply to the seal members 50 in the third direction Z is directly transferred to the downstream flow path member 40. However, the force does not act on the connecting parts of the seal members 50 and of the downstream flow paths 102. Thus, this configuration enables a force at which the seal member 50 presses the downstream flow path member 40 in the third direction Z to be weaker than a force at which the downstream flow path member 40 presses the seal member 50 in the direction opposite to the third direction Z.

Figure 8:
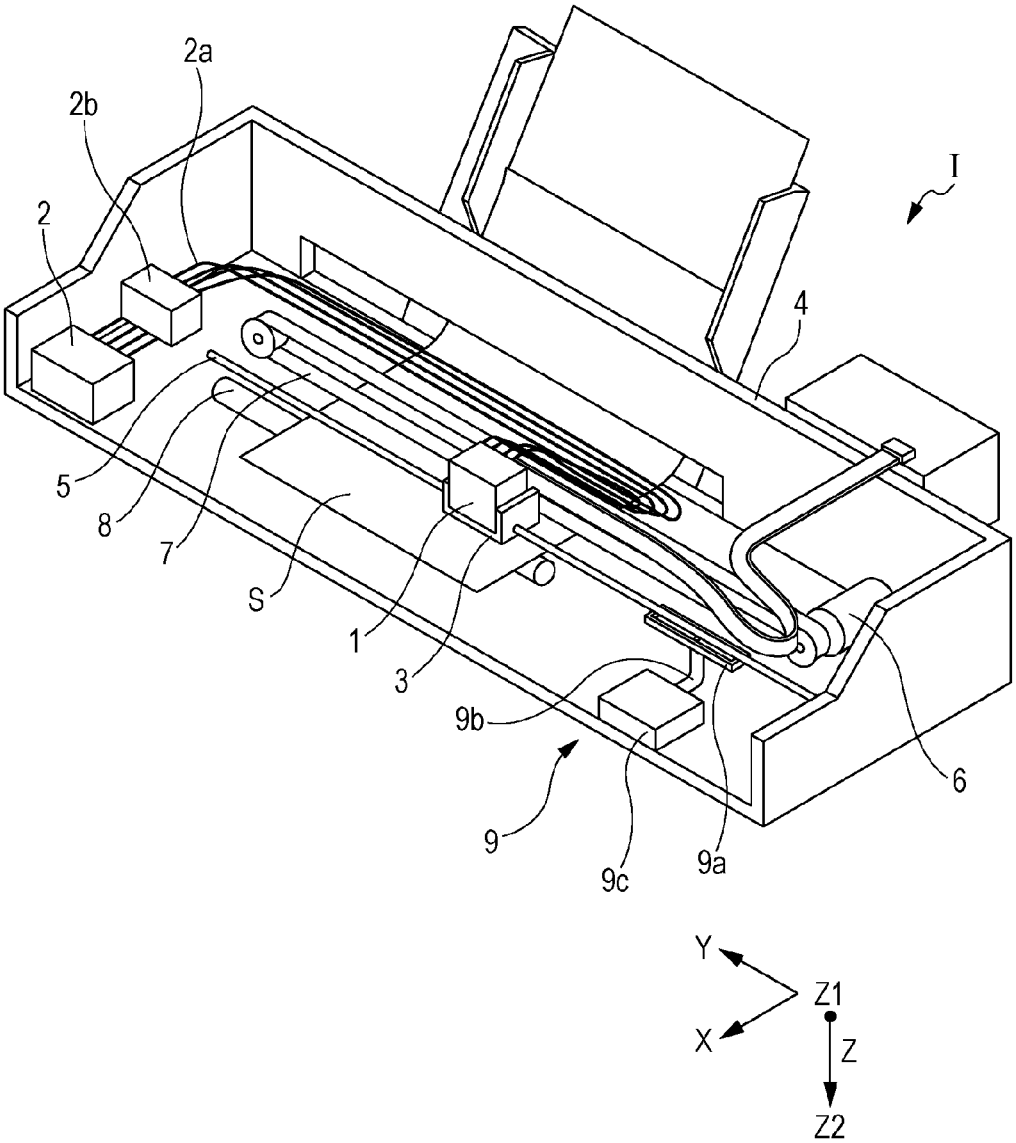
FIG. 8 is a perspective view illustrating a schematic configuration of a recording apparatus in an embodiment of the invention.

The ink jet recording head unit 1 in the first or second embodiment is configured to be mounted in an ink jet recording apparatus. FIG. 8 is a perspective view illustrating a schematic configuration of an ink jet recording apparatus, which is an example of a liquid ejecting apparatus in this embodiment.

As illustrated in FIG. 8, an ink jet recording apparatus I includes a head unit 1 mounted on a carriage 3, which is movable along a carriage shaft 5 attached to an apparatus body 4.

A drive motor 6 transmits drive power to the carriage 3 through a plurality of gears (not illustrated) and a timing belt 7, thereby moving the carriage 3 along the carriage shaft 5 together with the head unit 1. The apparatus body 4 has a transport roller 8 as a transport unit, which transports a medium S, such as a paper sheet. The transport unit that transports the medium S may be implemented using not only a transport roller but also a belt or a drum, for example.

The ink jet recording apparatus I includes a liquid storage unit 2, which is fixed to the apparatus body 4 and stores ink therein. The liquid storage unit 2 is connected to supply pipes 2*a*, each of which is a pipe-shaped part implemented using a flexible tube in which a flow path through which ink is supplied to the head unit 1 is formed.

A pump 2*b* is provided in the supply pipes 2*a* at its midway point. The pump 2*b* serves as a feeding unit that applies pressure to the ink, feeding the ink to the head unit 1. In response to driving of the pump 2*b* at a preset timing, the pump 2*b* feeds the ink from the liquid storage unit 2 to the head unit 1 at a predetermined pressure.

The ink jet recording apparatus I includes a cleaning unit 9 within an area in which no printing operation is performed. The cleaning unit 9 sucks ink, bubbles, or foreign matter from the flow paths through the nozzles of the head unit 1.

The cleaning unit 9 includes a cap member 9*a* and an aspirator 9*c*; the cap member 9*a* covers the nozzles of the head unit 1, and an aspirator 9*c*, which is implemented using a vacuum pump, for example, is connected to the cap member 9*a* via a suction tube 9*b*.

The cleaning unit 9 configured above abuts the cap member 9*a* against a liquid ejection surface 12 of the head unit 1 and then causes the aspirator 9*c* to perform a sucking operation. In this case, the aspirator 9*c* generates a negative pressure in the cap member 9*a*, sucking ink containing bubbles from the flow paths through the nozzles. In this way, a cleaning operation is performed. When no printing operation is performed, the cap member 9*a* may still cover the nozzles, thereby suppressing the nozzles from being dry.

The cap member 9*a* covers the nozzles at a desired timing by abutting against the liquid ejection surface 12 on which the nozzles are open. In this embodiment, therefore, the cap member 9*a* is movable in the third direction Z. The cap member 9*a* may be moved by a drive motor (not illustrated) or other moving mechanisms having an electromagnet, for example.

If the nozzles are arranged at a high density in the head unit 1 in the ink jet recording apparatus I, there are cases where the aspirator 9*c* does not have a capacity to reliably suck ink from the flow paths in the head unit 1. Therefore, when the cleaning unit 9 sucks ink from the flow paths through the nozzles, the pump 2*b* preferably applies pressure to ink supplied from the liquid storage unit 2. When the pressure is applied to the ink in the head unit 1, the retaining parts 39 provided in the head unit 1 as in the foregoing first embodiment successfully reduce the risk of ink leaking from the connecting parts of the upstream flow paths 101 in the upstream flow path members 30 and of the downstream flow paths 102 in the downstream flow path member 40.

The timing when the pump 2*b* applies pressure to the ink in the head unit 1 is not limited to when the cleaning operation is performed. For example, if valving elements that cause upstream flow paths to communicate with corresponding downstream flow paths when the downstream flow has a negative pressure are provided in the downstream flow path member 40, the pump 2*b* may continuously apply pressure to the ink supplied from the liquid storage unit 2.

Although the upstream flow paths 101 is provided in the upstream flow path members 30 and the downstream flow path 102 is provided in the downstream flow path member 40 in the foregoing first embodiment, for example, the upstream and downstream sides may be reversed in order to circulate the ink inside the flow path member 20. More specifically, the ink that has been supplied to the recording heads 10 may be caused to flow from the downstream flow paths 102 to the upstream flow paths 101 so that the ink is purged to or circulate through the liquid storage unit 2 or a storage unit that stores discharged ink.

In the ink jet recording apparatus I described above, the head unit 1 mounted on the carriage 3 is movable in the main-scanning directions; however, there is no limitation on movement of the head unit 1. For example, the head unit 1 may be fixed at a preset location, and the transport roller 8 may move the medium S, such as a paper sheet, in the sub-scanning directions when the printing operation is performed. In short, the head unit 1 may be applicable to so-called line type recording apparatuses.

In the ink jet recording apparatus I described above, the liquid storage unit 2 is fixed to the apparatus body 4; however, there is no limitation on a configuration of the ink jet recording apparatus I. For example, an ink cartridge may be attached directly to the carriage 3, and the liquid storage unit may be separated from the ink jet recording apparatus I.

The embodiments of the invention are applicable to a wide variety of liquid ejecting head units. Examples of such liquid ejecting head units include: a recording head, such as an ink jet recording head, provided in a printer or some other image recording apparatus; a color material ejecting head used to manufacture color filters for liquid crystal displays; an electrode material ejecting head used to fabricate electrodes for organic EL displays (FEDs), field emission displays, and other similar displays; and a liquid ejecting head unit having a bioorganic substance ejecting head for use in manufacturing biochips.

CROSS REFERENCES TO RELATED APPLICATIONS

This application claims priority to Japanese Patent Application No. 2015-137264 filed on Jul. 8, 2015. The entire disclosure of Japanese Patent Application No. 2015-137264 is hereby incorporated herein by reference.

What is claimed is:

1. A liquid ejecting head unit comprising:

a first flow path member having a first flow path;

a second flow path member having a second flow path, the second flow path member being stacked on the first flow path member;

a seal member that connects the first flow path to the second flow path, the seal member having a first seal part and a second seal part, the first flow path member applying a force to the first seal part in a stacking direction in which the second flow path member is stacked on the first flow path member, the second flow path member applying a force to the second seal part in a direction from a center of the second flow path to an outside thereof, the direction being perpendicular to the stacking direction;

a retaining part configured to bar against expansion of the seal member in the perpendicular direction; and a recording head configured to eject liquid through a nozzle, the liquid supplied through both the first flow path and the second flow path, wherein the retaining part is aligned with the second seal part in the stacking direction, and wherein the seal member has a projection that protrudes from the center of the second flow path to the outside thereof in the perpendicular direction and that abuts against the retaining part.

2. The liquid ejecting head unit according to claim 1, wherein an outer diameter of the first seal part is smaller than an inner diameter of the retaining part, as viewed from the stacking direction.

3. The liquid ejecting head unit according to claim 2, wherein the seal member has a flat part disposed outside the second seal part with respect to a center of the first flow path in the perpendicular direction, the flat part has a first surface and a second surface, the first surface being at a side of the first flow path member, the second surface being at a side of the second flow path member, and the retaining part is disposed so as to face the first surface of the flat part.

4. The liquid ejecting head unit according to claim 3, wherein the retaining part has an abutting part that abuts against the flat part.

5. A liquid ejecting apparatus comprising:

the liquid ejecting head unit according to claim 3; and a transport unit that transports a medium on which liquid ejected from the liquid ejecting head unit is to be placed.

6. The liquid ejecting head unit according to claim 2, wherein the seal member has a seal coupler disposed outside the second seal part with respect to the center of the second flow path in the normal direction, and the seal coupler interconnects a plurality of second seal parts.

7. The liquid ejecting head unit according to claim 1, wherein the second flow path member has a projection that protrudes from the center of the second flow path to the outside thereof in the perpendicular direction and that abuts against the retaining part, and a corner of the projection which is farther from the first seal part in the stacking direction is chamfered.

8. The liquid ejecting head unit according to claim 1, wherein the seal member has a seal coupler disposed outside the second seal part with respect to the center of the second flow path in the normal direction, and the seal coupler interconnects a plurality of second seal parts.

9. A liquid ejecting apparatus comprising:

the liquid ejecting head unit according to claim 1; and a transport unit that transports a medium on which liquid ejected from the liquid ejecting head unit is to be placed.

10. The liquid ejecting head unit according to claim 2, wherein the second flow path member has a projection that protrudes from the center of the second flow path to the outside thereof in the perpendicular direction and that abuts against the retaining part, and a corner of the projection which is farther from the first seal part in the stacking direction is chamfered.

11. A liquid ejecting head unit comprising:

a first flow path member having a first flow path;

a second flow path member having a second flow path, the second flow path member being stacked on the first flow path member;

a seal member that connects the first flow path to the second flow path, the seal member having a first seal part and a second seal part, the first flow path member applying a force to the first seal part in a stacking direction in which the second flow path member is stacked on the first flow path member, the second flow path member applying a force to the second seal part in a direction from a center of the second flow path to an outside thereof, the direction being perpendicular to the stacking direction;

a retaining part configured to bar against expansion of the seal member in the perpendicular direction; and a recording head configured to eject liquid through a nozzle, the liquid supplied through both the first flow path and the second flow path, wherein the seal member has a flat part disposed outside the second seal part with respect to a center of the first flow path in the perpendicular direction, and wherein the seal member has a projection that protrudes from the center of the second flow path to the outside thereof in the perpendicular direction and that abuts against the retaining part, the flat part has a first surface and a second surface, the first surface being at a side of the first flow path member, the second surface being at a side of the second flow path member, and the retaining part is disposed so as to face the first surface of the flat part.

12. The liquid ejecting head unit according to claim 11, wherein the retaining part has an abutting part that abuts against the flat part.

13. The liquid ejecting head unit according to claim 11, wherein the second flow path member has a projection that protrudes from the center of the second flow path to the outside thereof in the perpendicular direction and that abuts against the retaining part, and a corner of the projection which is farther from the first seal part in the stacking direction is chamfered.

14. The liquid ejecting head unit according to claim 11, wherein the retaining part is aligned with the second seal part in the stacking direction.

15. The liquid ejecting head unit according to claim 11, wherein the seal member has a seal coupler disposed outside the second seal part with respect to the center of the second flow path in the normal direction, and the seal coupler interconnects the plurality of second seal parts.

16. A liquid ejecting head unit comprising:

a first flow path member having a first flow path;

a second flow path member having a second flow path, the second flow path member being stacked on the first flow path member;

a seal member that connects the first flow path to the second flow path, the seal member having a first seal part and a second seal part, the first flow path member applying a force to the first seal part in a stacking direction in which the second flow path member is stacked on the first flow path member, the second flow path member applying a force to the second seal part in a direction from a center of the second flow path to an outside thereof, the direction being perpendicular to the stacking direction;

a retaining part configured to bar against expansion of the seal member in the perpendicular direction; and a recording head configured to eject liquid through a nozzle, the liquid supplied through both the first flow path and the second flow path, wherein the seal member has a projection that protrudes from the center of the second flow path to the outside thereof in the perpendicular direction and that abuts against the retaining part, and a corner of the projection which is closer to the first seal part in the stacking direction is chamfered.

* * * * *